US006432595B1

(12) United States Patent
Kawaguchi et al.

(10) Patent No.: US 6,432,595 B1
(45) Date of Patent: Aug. 13, 2002

(54) SINGLE-LAYER TYPE ELECTROPHOTOSENSITIVE MATERIAL AND IMAGE FORMING APPARATUS USING THE SAME

(75) Inventors: Hirofumi Kawaguchi, Osaka; Yuji Tanaka, Yao; Yukikatsu Imanaka; Nobuko Akiba, both of Osaka, all of (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/717,397

(22) Filed: Nov. 22, 2000

(30) Foreign Application Priority Data

Nov. 29, 1999 (JP) ..... 11-337632

(51) Int. Cl.[7] ..... G03G 15/00

(52) U.S. Cl. ..... 430/56; 430/73

(58) Field of Search ..... 430/56, 73

(56) References Cited

U.S. PATENT DOCUMENTS 5,087,540 A * 2/1992 Murakami et al. ..... 430/78

* cited by examiner

*Primary Examiner*—Mark Chapman
(74) *Attorney, Agent, or Firm*—Smith, Gambrell & Russell

(57) ABSTRACT

The present invention relates to a positive charging single-layer type electrophotosensitive material comprising a conductive substrate and a photosensitive layer formed on the conductive layer, the photosensitive layer containing a phthalocyanine compound as an electric charge generating material, wherein a large half-life exposure between a half-life exposure on positive charging and a half-life exposure on negative charging is four times or less as much as that of the other half-life exposure., and a reversal development type digital image forming apparatus, comprising the electrophotosensitive material, said reversal development type digital image forming apparatus being provided with at least a main charging step, an exposure step, a developing step, a transferring step, a charge neutralizing step and a cleaning step in the forward direction of the electrophotosensitive material, characterized in that the voltage to be applied in the transferring step has a polarity reverse to that of the voltage to be applied in the charging step.

9 Claims, 1 Drawing Sheet

SINGLE-LAYER TYPE ELECTROPHOTOSENSITIVE MATERIAL AND IMAGE FORMING APPARATUS USING THE SAME

BACKGROUND OF THE INVENTION

The present invention relates to an electrophotosensitive material, which is used in image forming apparatuses such as electrophotographic copying machine, facsimile and laser beam printer, and an image forming method using the same. More particularly, the present invention relates to a single-layer type electrophotosensitive material which does not form a transfer memory image even when used in a reversal development type digital image forming apparatus, and a reversal development type digital image forming method using the same.

Recently, an organic photosensitive material has widely been used because it is easily produced at low cost as compared with a conventional inorganic photosensitive material and has advantages, for example, wide range of choice of photosensitive materials such as electric charge transferring material, electric charge generating material and binder resin, and high functional design freedom.

The organic photosensitive material includes a single-layer type photosensitive material wherein an electric charge transferring material (hole transferring material and electron transferring material) is dispersed in the same photosensitive layer, together with an electric charge generating material, and a multi-layer type photosensitive material comprising an electric charge generating layer containing an electric charge generating material and an electric charge transferring layer containing an electric charge transferring material, which are mutually laminated.

According to an image forming apparatus using an electrophotographic system, an image is formed by charging a photosensitive material (main charging step), exposing the photosensitive material to light to form an electrostatic latent image (exposure step), developing the electrostatic latent image with a toner in the state where a developing bias voltage is applied (developing step), transferring the toner image thus formed to a transfer paper (transferring step), and fixing the toner image. The residual toner on the photosensitive material is cleaned by a urethane blade (cleaning step) and the residual charges on the photosensitive material are erased by LED (charge neutralizing step).

The image forming apparatus utilizing the electrophotographic system includes digital and analogue copying machines, facsimile, and laser beam printer and, in particular, a reversal development system for developing using a toner having the same polarity as that of the charged voltage to be applied to the photosensitive material in the charging step has widely been used in a digital image forming apparatus.

When using the electrophotosensitive material in the reversal development type digital image forming apparatus, the transfer voltage to be applied to the photosensitive material in the transferring step is usually applied through a transfer medium (paper) without being directly applied to the photosensitive material, but is not applied when the transfer medium does not pass through the transferring step.

However, on-off timing of the transfer voltage is very difficult and the portion where the transfer voltage is applied directly to the photosensitive material is formed occasionally with respect to front and rear ends of the transfer medium. That is, the application of the transfer voltage starts before a transferring apparatus is covered with the front end of the transfer medium. Even if the rear end of the transfer medium passes through, thereby partially exposing the transferring apparatus, the transfer voltage is still applied continuously so that the transfer voltage is applied directly to the photosensitive material at the portion.

In case of the positive charging single-layer type photosensitive material, since the voltage to be applied by the transferring apparatus has a negative polarity, there arises so-called transfer memory wherein negative space charges are remained on the surface of the photosensitive material to which a negative voltage is applied. In general, since the single-layer type photosensitive material has the sensitivity in both polarities, negative space charges are erased in the subsequent charge neutralizing step.

However, in case the sensitivity of the positive charge single-layer type photosensitive material to a negative polarity is very poor (half-life exposure is very large), negative space charges are not erased sufficiently. If the photosensitive material is positively charged in the subsequent charging step, fall of potential is caused by an influence of space charges. In the developing step, a difference in sensitivity causes a so-called transfer memory image wherein the portion becomes black in the image.

In the image forming apparatus using the positive charging single-layer type electrophotosensitive material, the voltage to be applied by the transferring apparatus has a negative polarity and the voltage to be applied by a charging apparatus has a positive polarity. Therefore, ozone is evolved in the vicinity of the transferring apparatus, while Nox is evolved in the vicinity of the charging apparatus. Evolution of the gas tends to become severe in a large size image forming apparatus having a large voltage applied.

It has been known that exposure of the surface of the electrophotosensitive material to the gas lowers the charged potential of the portion, thereby causing image fog and black streaking.

SUMMARY OF THE INVENTION

Thus, an object of the present invention is to provide a single-layer type electrophotosensitive material which causes less transfer memory and no transfer memory image even when using in a reversal development type image forming apparatus, and is also superior in resistance to gases such as ozone, NOx and the like, and which is free from image defects even when using in a large size image forming apparatus.

Another object of the present invention is to provide a reversal development type image forming apparatus using the single-layer type electrophotosensitive material.

To attain the objects descried above, the present inventors have intensively studied and found such a fact that a transfer memory image is hardly formed even when using a positive charging single-layer type electrophotosensitive material comprising a conductive substrate and a photosensitive layer formed on the conductive layer, the photosensitive layer containing a phthalocyanine compound as an electric charge generating material, characterized in that a large half-life exposure between a half-life exposure on positive charging and a half-life exposure on negative charging is four times or less as much as that of the other half-life exposure in the reversal development type image forming apparatus because of its less transfer memory.

That is, the present invention includes the following inventions:

1) A positive charging single-layer type electrophotosensitive material comprising a conductive substrate and a photosensitive layer formed on the conductive layer, the photosensitive layer containing a phthalocyanine compound as an electric charge generating material, wherein a large half-life exposure between a half-life exposure on positive charging and a half-life exposure on negative charging is four times or less as much as that of the other half-life exposure.

2) The positive charging single-layer type electrophotosensitive material according to the term 1), which contains at least a hole transferring material and an electron transferring material.

3) The positive charging single-layer type electrophotosensitive material according to the term 2) wherein the half-life exposure on positive charging is smaller than the half-life exposure on negative charging.

4) The positive charging single-layer type electrophotosensitive material according to the term 3), which contains, as the electron transferring material, at least one compound represented by the general formula (1):

(1)

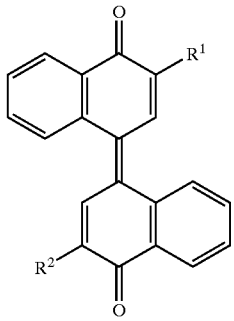

wherein $R^1$ and $R^2$ are the same or different and each represents a monovalent hydrocarbon group which may have a substituent, the general formula (2):

(2)

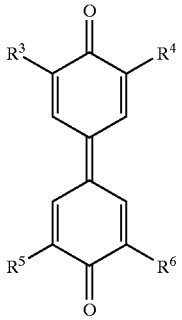

wherein $R^3$, $R^4$, $R^6$ and $R_6$ are the same or different and each represents an alkyl group or an aryl group, or the general formula (3):

(3)

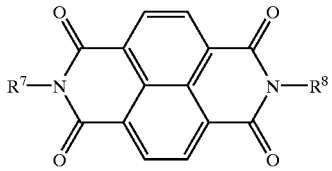

wherein $R^7$ and $R^8$ are the same or different and each represents a monovalent hydrocarbon group which may have a substituent, or the general formula (4):

(4)

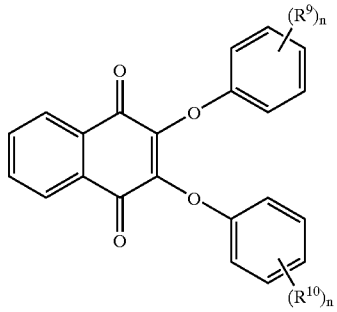

wherein $R^9$ and $R^{10}$ are the same or different and each represents an alkyl group, a halogenated alkyl group, an aryl group, an aralkyl group, an alkoxy group, an aryloxy group, an aralkyloxy group, an acyl group, an alkoxycarbonyl group, an aryloxycarbonyl group, an aralkyloxycarbonyl group, or a nitro group, and n represents an integer of 0 to 3.

5) The positive charging single-layer type electrophotosensitive material according to the term 3), which contains, as the hole transferring material, at least one compound represented by the general formula (5):

(5)

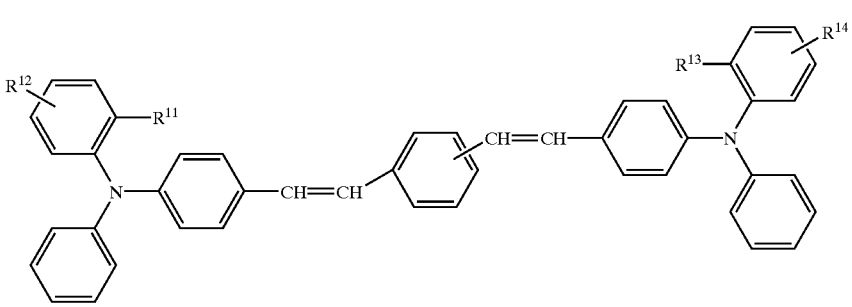

wherein $R^{11}$ and $R^{13}$ are the same or different and each represents an alkyl group which may have a substituent, an aryl group which may have a substituent, or an aralkyl or alkoxy group which may have a substituent, and $R^{12}$ and $R^{14}$ are the same or different and each represents a hydrogen atom, or an alkyl or alkoxy group which may have a substituent, provided that $R^{12}$ and $R^{14}$ are hydrogen atoms when the substitution position of $R^{12}$ and $R^{14}$ is para-position, or the general formula (6):

(6)

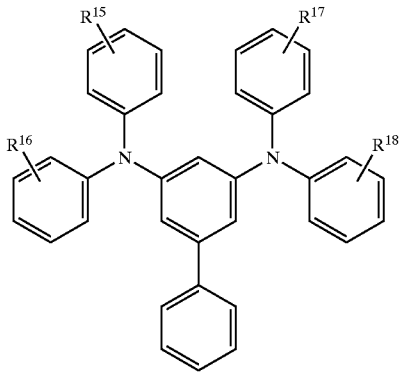

wherein $R^{15}$ and $R^{17}$ represent the same or different alkyl group, and $R^{16}$ and $R^{18}$ are the same or different and each represents a hydrogen atom or an alkyl group.

6) The positive charging single-layer type electrophotosensitive material according to the term 3), which contains a terphenyl compound represented by the general formula (7):

(7)

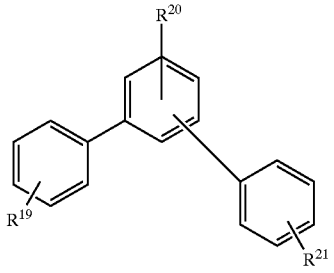

wherein $R^{19}$, $R^{20}$ and $R^{21}$ are the same or different and each represents a hydrogen atom, or an alkyl, aryl or amino group which may have a substituent.

7) The single-layer type electrophotosensitive material according to the term 3), which contains the electron transferring material represented by the general formula (1), the hole transferring material represented by the general formula (6), and the terphenyl compound represented by the general formula (7).

8) The positive charging single-layer type electrophotosensitive material according to the term 3), which contains, as a binder resin, a bisphenol Z polycarbonate resin having a weight-average molecular weight of 10,000 to 400,000.

9) A positive charging reversal development type digital image forming apparatus, comprising the positive charging electrophotosensitive material of the term 1), said reversal development type digital image forming apparatus being provided with at least a main charging step, an exposure step, a developing step, a transferring step, a charge neutralizing step and a cleaning step in the forward direction of the electrophotosensitive material, wherein the voltage to be applied in the transferring step has a polarity reverse to that of the voltage to be applied in the charging step.

10) A positive charging reversal development type digital image forming apparatus, comprising the positive charging electrophotosensitive material of the term 3), said reversal development type digital image forming apparatus being provided with at least a main charging step, an exposure step, a developing step, a transferring step, a charge neutralizing step and a cleaning step in the forward direction of the electrophotosensitive material, wherein the voltage to be applied in the transferring step has a negative polarity and the voltage to be applied in the charging step has a positive polarity.

In the single-layer type electrophotosensitive material of the present invention, a larger half-life exposure among half-life exposures on positive and negative charging is four times or less as much as that of the other half-life exposure.

In case of the positive charging single-layer type electrophotosensitive material, although the half-life exposure on positive charging is smaller than the half-life exposure on negative charging (sensitivity is better), when the half-life exposure on positive charging is four times or less as much as that on negative charging, electrons remained on the surface of the photosensitive material in the transferring step are sufficiently erased in the charge neutralizing step as described above. In other words, since transportation balance of electrons and holes in the photosensitive layer becomes better with the decrease of a difference between the photosensitivity on positive charging and photosensitivity on negative charging, a small influence of space charges is exerted, thereby reducing the transfer memory.

Even when using the electrophotosensitive material of the present invention in a reversal development type image forming apparatus, it causes less transfer memory and no transfer memory image. Since the positive charging single-layer type electrophotosensitive material of the present invention is superior in resistance to gases such as ozone, NOx and the like, image fog and black streaking do not occur even when using in a large size image forming apparatus where a large amount of gases are evolved.

DETAILED DESCRIPTION OF THE INVENTION

Figure 1:
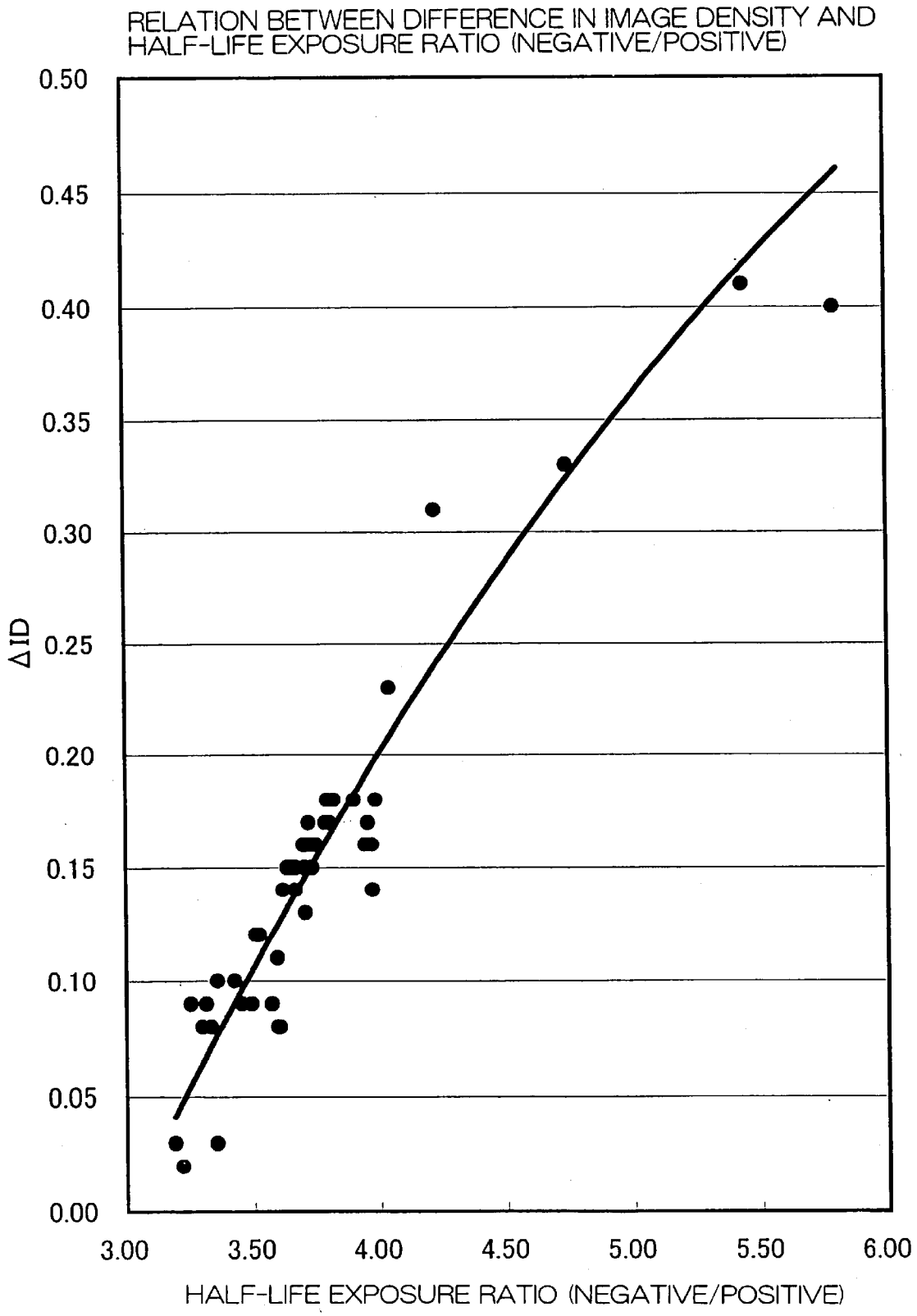
FIG. 1 is a graph showing a relation between the ratio of (half-life exposure on negative charging) to (half-life exposure on positive charging) plotted against the difference in image density (ΔID) in creage 630 with respect to the single-layer type electrophotosensitive materials of Examples 1 to 32 and Comparative Examples 1 to 6.

The single-layer type electrophotosensitive material is produced by forming a single photosensitive layer on a conductive substrate. This photosensitive layer is formed by dissolving or dispersing an electric charge generating material, a hole transferring material, an electron transferring material and a binder resin in a proper solvent, coating a conductive substrate with the resulting coating solution, and drying the coating solution.

Various materials used in the single-layer type electrophotosensitive material of the present invention will be described in detail.

<Electric Charge Generating Material>

In a digital image forming apparatus, a semiconductor laser is generally used in view of its small size, cheap price and simplicity when using laser as a light source. At present, the oscillation wavelength of the semiconductor laser is 700 nm or more and is limited to the infrared range. Accordingly, an organic photosensitive material having a sensitivity at a wavelength ranging from 700 to 850 nm is required.

As the electric charge generating material used in the organic photosensitive material, which satisfies the above requirements, for example, polycyclic quinone compound, pyrylium compound, squarium compound, phthalocyanine compound and azo compound have been suggested or applied into practical use. In the single-layer type electrophotosensitive material, various phthalocyanines are used.

Generally, the phthalocyanine compound includes, for example, metal-free phthalocyanine (CGM-1) having no center metal, and metallic phthalocyanine having a center metal which has intensively developed, recently, such as aluminum phthalocyanine, vanadium phthalocyanine, cadmium phthalocyanine, antimony phthalocyanine, chromium phthalocyanine, copper 4-phthalocyanine, germanium phthalocyanine, iron phthalocyanine, chloroaluminum phthalocyanine, titanyl phthalocyanine (CGM-2), chloroindium phthalocyanine, chlorogallium phthalocyanine, magnesium phthalocyanine, dialkyl phthalocyanine, tetarmethyl phthalocyanine, and tetraphenyl phthalocyanine. The phthalocyanine compound have various crystal forms (e.g. $\alpha$, $\beta$, $\gamma$, $\delta$, $\epsilon$, $\sigma$ and x type crystal forms), and any of them can be used. These phthalocyanine compounds can be used alone or in combination.

The phthalocyanine compound is preferably incorporated in the amount within a range from 0.1 to 20% by weight, and particularly from 0.5 to 10% by weight, based on the weight of the binder resin.

<Electron Transferring Material>

The compound represented by the general formula (1), (2), (3) or (4) is preferably used in view of the photosensitivity and reduction in memory as the electron transferring material used in the single-layer type electrophotosensitive material of the present invention. When using the above compounds as the electron transferring material, the compounds are used alone or in combination. Various electron transferring materials may be contained, together with the above compounds.

Examples of various electron transferring materials include electron attractive substances such as pyrene compound, carbazole compound, hydrazone compound, N,N-dialkylaniline compound, diphenylamine compound, triphenylamine compound, triphenylmethane compound, tetracyanoethyl, tetracyanoquinodimethane, chloroanil, bromoanil, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothioxanthone, or electron attractive substances having a larger molecular weight.

The content of the electron transferring material is preferably within a range from 5 to 100% by weight, and more preferably from 10 to 80% by weight, based on the weight of the binder resin. The compound represented by the general formula (1), (2), (3) or (4) is incorporated in the amount within a range from 50 to 100% by weight based on the total weight of the electron transferring material.

<Hole Transferring Material>

The compound represented by the general formula (5) or (6) is preferably used in view of the photosensitivity and reduction in memory as the hole transferring material used in the single-layer type electrophotosensitive material of the present invention. When using the above compounds as the hole transferring material, the compounds are used alone or in combination. Various hole transferring materials may be contained, together with the above compounds.

Examples of various hole transferring materials include nitrogen-containing polycyclic compounds, for example, oxadiazole compound such as 2,5-di(4-methylaminophenyl)-1,3,4-oxadiazole, styryl compound such as 9-(4-diethylaminostyryl)anthracene, carbazole compound such as polyvinylcarbazole, organopolysilane compound, pyrazoline compound such as 1-phenyl-3-(p-dimethylaminophenyl)pyrazoline, hydrazone compound, triphenylamine compound, indole compound, oxazole compound, isoxazole compound, thiazole compound, thiadiazole compound, imidazole compound, pyrazole compound, triazole compound, and stilbene compound.

The content of the hole transferring material is preferably within a range from 5 to 500% by weight, and more preferably from 25 to 200% by weight, based on the weight of the binder resin. The compound represented by the general formula (5) or (6) is contained in the amount within a range from 50 to 100% by weight based on the total weight of the hole transferring material.

The single-layer type photosensitive material can be used in any of positive and negative charging type, but is preferably used in a positive charging type (half-life exposure on positive charging is smaller than half-life exposure on negative charging) because the mobility of the electron transferring material is generally smaller than that of the hole transferring material and the amount of ozone evolved in the image forming apparatus is drastically small).

<Binder Resin>

As the binder resin in which the above respective components are dispersed, there can be used various resins which have hitherto been used in the photosensitive layer.

There can be used thermoplastic resins such as styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, polyester, alkyd resin, polyamide, polyurethane, polycarbonate, polyallylate, polysulfone, diallyl phthalate polymer, ketone resin, polyvinyl butyral resin, polyether resin and polyester resin; crosslinkable, thermosetting resins such as silicone resin, epoxy resin, phenol resin, urea resin and melamine resin; and photocurable resins such as epoxy acrylate and urethane acrylate. These binder resins can be used alone or in combination.

Particularly preferable resin is a bisphenol Z polycarbonate derived from a bisphenol Z monomer such as PANLIGHT manufactured by TEIJIN CHEMICALS LTD or PCZ manufactured by Mitsubishi Gas Chemical Company, Inc. and phosgene.

The weight-average molecular weight of the binder resin is preferably within a range from 10,000 to 400,000, and more preferably from 30,000 to 200,000.

<Additives>

For the purpose of improving the resistance to the gas such as ozone, the terphenyl compound represented by the general formula (7) is incorporated into the single-layer type electrophotosensitive material of the present invention. Although details of the operation and mechanism thereof are not apparent, it is considered that a molecule of the terphenyl compound is incorporated into micropores of the surface of the photosensitive layer, thereby inhibiting a gas from penetrating into the surface of the photosensitive layer.

The content of the terphenyl compound is preferably within a range from 0.5 to 30% by weight, and more preferably from 1 to 10% by weight, based on the weight of the binder resin.

In addition to the above terphenyl compound, conventionally known various additives such as oxidation inhibitors, radical scavengers, singlet quenchers, antioxidants (e.g. ultraviolet absorbers), softeners, plasticizers, surface modifiers, excipients, thickeners, dispersion stabilizers, waxes, acceptors and donors can be incorporated into the single-layer type electrophotosensitive material as far as electrophotographic characteristics are not adversely affected.

In the single-layer type electrophotosensitive material of the present invention, the photo sensitivity, reduction in memory and gas resistance are improved by incorporating a combination of the electron transferring material represented by the general formula (1), the hole transferring material represented by the general formula (6) and the terphenyl compound represented by the general formula (7).

The film thickness of the single-layer type electrophotosensitive material is preferably within a range from about 5 to 50 $\mu$m, and particularly from about 15 to 35 $\mu$m.

A barrier layer may be formed between the conductive substrate and photosensitive layer in the single-layer type electrophotosensitive layer of the present invention as far as the characteristics of the photosensitive material are not adversely affected.

As the conductive substrate on which the photosensitive layer is formed, for example, various materials having the conductivity can be used. The substrate includes, for example, conductive substrates made of metallic simple substances such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; and substrates made of glasses coated with aluminum iodide, tin oxide and indium oxide.

The conductive substrate may be in the form of a sheet or drum according to the structure of the image forming apparatus to be used. The substrate itself may have the conductivity, or the surface of the substrate may have the conductivity. The conductive substrate may be preferably those having a sufficient mechanical strength on use.

When the photosensitive layer is formed by the coating method, a dispersion is prepared by dispersing and mixing the above electric charge transferring material, electric charge generating material and binder resin, together with a proper solvent, using a known method such as roll mill, ball mill, attritor, paint shaker, or ultrasonic dispersing equipment to prepare a dispersion, and then the resulting dispersion is coated by using a known means and dried.

As the solvent for preparing the dispersion, various organic solvents can be used. Examples thereof include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride and chlorobenzene; ethers such as dimethyl ether, diethyl ether, tetrahydrofuran, ethylene glycol dimethyl ether and diethylene glycol dimethyl ether; ketones such as acetone, methyl ethyl ketone and cylohexanone; esters such as ethyl acetate and methyl acetate; and dimethylformaldehyde, dimethylformamide and dimethyl sulfoxide. These solvents can be used alone, or two or more kinds of them can be used in combination.

To improve the dispersibility of the electric charge transferring material and electric charge generating material, and the smoothness of the surface of the photosensitive layer, for example, surfactants and leveling agents may be added.

The image forming apparatus of the present invention is a reversal development type digital image forming apparatus, comprising the electrophotosensitive material, said reversal development type digital image forming apparatus being provided with at least a main charging step, an exposure step, a developing step, a transferring step, a charge neutralizing step and a cleaning step in the forward direction of the electrophotosensitive material, characterized in that the voltage to be applied in the transferring step has a polarity reverse to that of the voltage to be applied in the charging step. Examples of the image forming apparatus include digital copying machine, facsimile and laser beam printer.

When using the single-layer type electrophotosensitive material in a positive charging type, the voltage to be applied in the charging step has a positive polarity, while the voltage to be applied in the transferring step has a negative polarity.

Even when using the single-layer type electrophotosensitive material of the present invention in the image forming apparatus, it does not cause a memory image because of its very small transfer memory. Since the positive charging single-layer type electrophotosensitive material of the present invention is superior in resistance to gases such as ozone, NOx and the like, image fog and black streaking do not occur even when using in a large size image forming apparatus where a large amount of gases are evolved.

EXAMPLES

The following Examples and Comparative Examples further illustrate the present invention in detail. The following Examples are for specifically describing the embodiments of the invention, but the technical scope of the present invention is not limited thereby.

[Evaluation Method]

The method of evaluating the electrophotosensitive materials obtained in the following Examples and Comparative Examples will be described.

(1) Evaluation of Half-life Exposure (on Positive Charging)

Using a drum sensitivity tester manufactured by GENTEC Co. under the trade name of GENTEC CYNTHIA 30M, a voltage was applied to each photosensitive material to charge the surface at +700 V, and an initial surface potential $V_0$ (V) was measured.

The surface of each photosensitive material was irradiated (exposure time: 1.5 sec) with monochromic light having a wavelength of 780 nm (half-width: 20 nm, light intensity I: 8 $\mu$W/cm$^2$) from white light of a halogen lamp as an exposure light source through a band-pass filter, and then the time $t_{1/2}$ (sec) required to reduce the surface potential of the photosensitive material to half of the initial surface potential was measured and a half-life exposure $E_{P1/2}$ ($\mu$J/cm$^2$) on positive charging was determined by the equation (1).

$$E_{P1/2}=I\times t_{1/2} \quad \text{Equation (1)}$$

The smaller the half-life exposure, the higher the sensitivity of the photosensitive material.

(2) Evaluation of Half-life Exposure (on Negative Charging)

In the same manner as in case of the evaluation of half-life exposure on positive charging, except that a voltage was applied to each photosensitive material to charge the surface at −700 V, a half-life exposure $E_{N1/2}$ ($\mu$J/cm$^2$) on negative charging was determined.

(3) Evaluation of Transfer Memory

Using a digital copying machine manufactured by KYOCERA MITA CORPORATION under the trade name of Creage 630, each of electrophotosensitive materials of the respective Examples and Comparative Examples was uniformly charged to +850 V, image exposure was conducted by output of a half-tone having a reflection optical density of about 0.5. After applying a developing bias of +650 V, reversal development was conducted by using a two-component developer containing a positive charging toner. Then, the resulting toner image was transferred to a transfer paper at a transfer output of 6 kV and fixed to obtain an image for evaluation. Samples where a difference in image density (ΔID) between the portion having a large image density (transfer memory image), which appears in a belt shape in the longitudinal direction of a cylinder of a photosensitive material, of the image for evaluation and other portions is 0.2 or less were rated "failure".

(3) Evaluation of Ozone Resistance

Using a digital copying machine manufactured by KYOCERA MITA CORPORATION under the trade name of Creage 7320, the surface potential of each single-layer type photosensitive material was measured. The photosensitive material was exposed in a dark place at normal temperature under an atmosphere having an ozone concentration of 10 ppm for 10 hours, and then the surface potential immediately after exposure was measured in the same manner and the value $\Delta V_0$ (=[initial surface potential]−[surface potential immediately after exposure]) was calculated. The smaller the value $\Delta V_0$, the better the ozone resistance of the photosensitive material.

Examples 1 to 32

2.0 Parts by weight of a X type metal-free phthalocyanine (CGM-1) as the electric charge generating material, 60 parts by weight of one selected from HT-1 to HT-6 as the hole transferring material, 30 parts by weight of one selected from compounds of the general formula (1) [ET-101 to ET-115], the general formula (2) [ET-201 to ET-215] and the general formula (3) [ET-301 to ET-315] as the electron transferring material, 100 parts by weight of a bis-Z type polycarbonate resin having a weight-number average molecular weight of 50,000 as the binder resin and 800 parts by weight of tetrahydrofuran were dispersed or dissolved in a ball mill for 24 hours to prepare a coating solution for single-layer type photosensitive layer. Then, an aluminum tube as the conductive substrate was coated with the coating solution by a dip coating method, followed by hot-air drying at 135° C. for 30 minutes to produce single-layer type electrophotosensitive materials having a single photosensitive layer of 23 μm in film thickness, respectively.

Substituents ($R^1$ to $R^8$) of the compounds of the general formula (1) [ET-101 to ET-115], the general formula (2) [ET-201 to ET-215] and the general formula (3) [ET-301 to ET-315] used as the electron transferring material in the respective Examples are shown in Table 1, Table 2 and Table 3, respectively. In these tables, Me denotes a methyl group, Et denotes an ethyl group, t-Bu denotes a tertiary butyl group, Ph denotes a phenyl group, MeO denotes a methoxyl group and Bzl denotes a benzyl group, respectively.

TABLE 1

| Compound No. | $R^1$ | $R^2$ |
|---|---|---|
| ET-101 | Me | Me |
| ET-102 | Et | Et |
| ET-103 | t-Bu | t-Bu |
| ET-104 | $C_4H_9(C_2H_5)CHCH_2$— | $C_4H_9(C_2H_5)CHCH_2$— |
| ET-105 | Ph | Ph |
| ET-106 | $CH_3C_6H_4$— | $CH_3C_6H_4$— |
| ET-107 | Bz1 | Bz1 |
| ET-108 | $C_6H_{11}$— | $C_6CH_{11}$— |
| ET-109 | $C_2H_5(CH_3)_2C$— | $C_2H_5(CH_3)_2C$— |
| ET-110 | $CH_3(C_2H_5)_2C$— | $CH_3(C_2H_5)_2C$— |
| ET-111 | Me | Me |
| ET-112 | t-Bu | Me |
| ET-113 | Et | t-Bu |
| ET-114 | Ph | Me |
| ET-115 | $CH_3(C_2H_5O)CHCH_2$— | $CH_3(C_2H_5O)CHCH_2$— |

TABLE 2

| Compound No. | $R^3$ | $R^4$ | $R^5$ | $R^6$ |
|---|---|---|---|---|
| ET-201 | Me | Me | Me | Me |
| ET-202 | Et | Et | Et | Et |
| ET-203 | Me | Me | t-Bu | t-Bu |
| ET-204 | t-Bu | t-Bu | t-Bu | t-Bu |
| ET-205 | t-Bu | Ph | t-Bu | t-Bu |
| ET-206 | t-Bu | Ph | Ph | t-Bu |
| ET-207 | t-Bu | t-Bu | Ph | Ph |
| ET-208 | Ph | Ph | Ph | Ph |
| ET-209 | t-Bu | t-Bu | MeO | MeO |
| ET-210 | $C_4H_9(C_2H_5)CHCH_2$— | $C_4H_9(C_2H_5)CHCH_2$— | $C_4H_9(C_2H_5)CHCH_2$— | $C_4H_9(C_2H_5)CHCH_2$— |
| ET-211 | $CH_3C_6H_4$— | $CH_3C_6H_4$— | $CH_3C_6H_4$— | $CH_3C_6H_4$— |
| ET-212 | Bz1 | Bz1 | Bz1 | Bz1 |
| ET-213 | $C_6H_{11}$— | $C_6H_{11}$— | $C_6H_{11}$— | $C_6H_{11}$— |
| ET-214 | $CH_3(C_2H_5O)CHCH_2$— | $CH_3(C_2H_5O)CHCH_2$— | $CH_3(C_2H_5O)CHCH_2$— | $CH_3(C_2H_5O)CHCH_2$— |
| ET-215 | Me | t-Bu | Me | t-Bu |

TABLE 3

| Compound No. | $R^7$ | $R^8$ |
|---|---|---|
| ET-301 | Me | Me |
| ET-302 | Et | Et |
| ET-303 | t-Bu | t-Bu |
| ET-304 | $C_4H_9(C_2H_5)CHCH_2$— | $C_4H_9(C_2H_5)CHCH_2$— |
| ET-305 | Ph | Ph |
| ET-306 | $CH_3C_6H_4$— | $CH_3C_6H_4$— |
| ET-307 | Bz1 | Bz1 |
| ET-308 | $C_6H_{11}$— | $C_6CH_{11}$— |
| ET-309 | $C_2H_5(CH_3)_2C$— | $C_2H_5(CH_3)_2C$— |

TABLE 3-continued
| Compound No. | $R^7$ | $R^8$ |
|---|---|---|
| ET-310 | $CH_3(C_2H_5)_2C—$ | $CH_3(C_2H_5)_2C—$ |
| ET-311 | Me | Me |
| ET-312 | t-Bu | Me |
| ET-313 | Et | t-Bu |
| ET-314 | Ph | Me |
| ET-315 | $CH_3(C_2H_5O)CHCH_2—$ | $CH_3(C_2H_5O)CHCH_2—$ |
Chemical structural formulas of HT-1, HT-2, HT-3, HT-4, HT-5 and HT-6 used as the hole transferring material are shown below.
HT-1
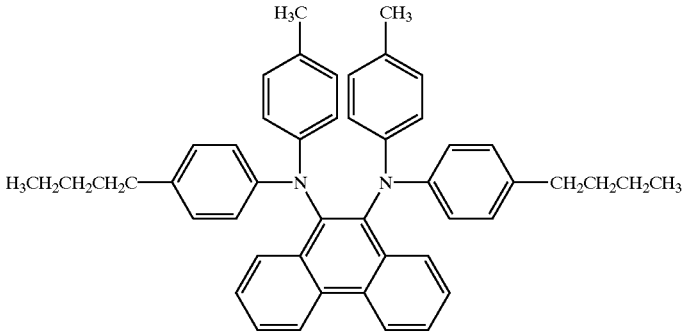
HT-2
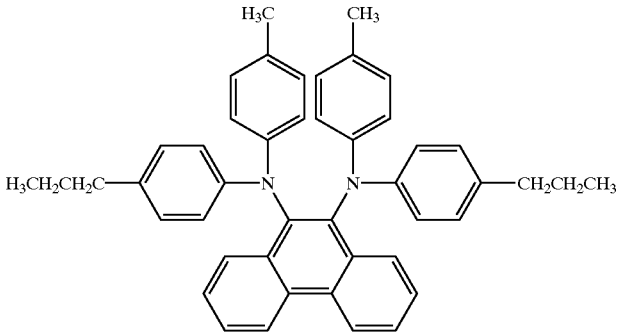
HT-3
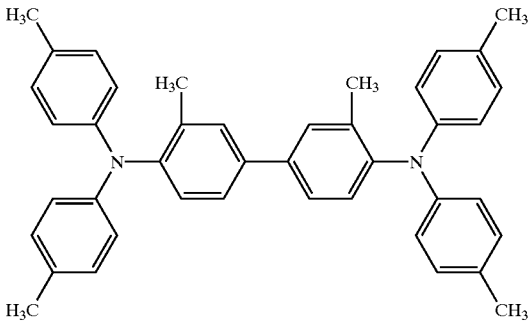
HT-4
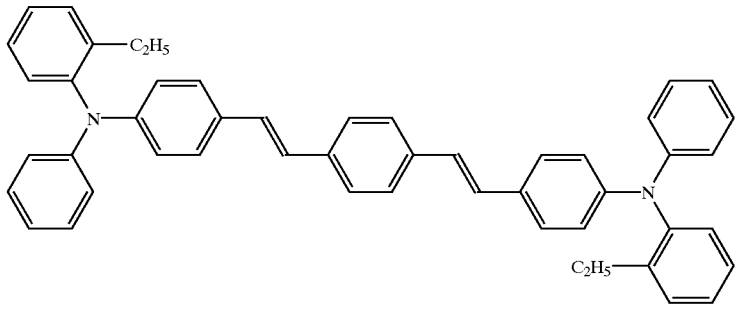

-continued

HT-5

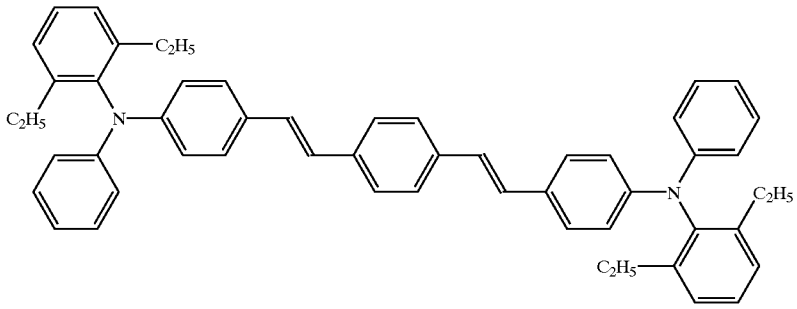

HT-6

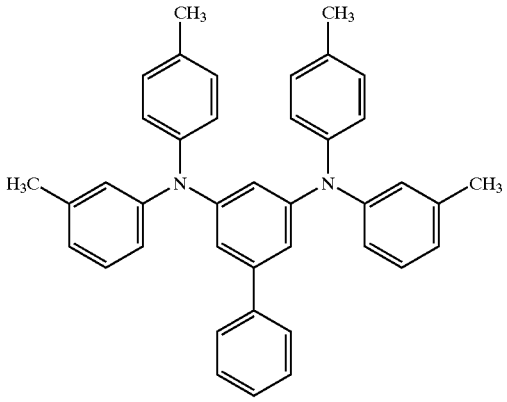

Comparative Examples 1 to 6

In the same manner as in Examples 1 to 32, except that ET-1 or ET-2 represented by the following chemical structural formula was used as the electron transferring material, single-layer type photosensitive materials were produced, respectively.

ET-1

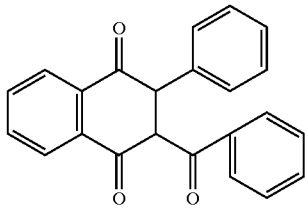

-continued

ET-2

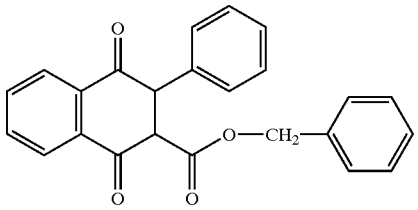

With respect to the single-layer type electrophotosensitive materials obtained in Examples 1 to 32 and Comparative Examples 1 to 6, the half-life exposure (on positive charging), half-life exposure (on negative charging) and transfer memory are evaluated. The results of Examples 1 to 32 are shown in Table 4 and those of and Comparative Examples 1 to 6 are shown in Table 5, respectively. Based on the results of Table 4 and Table 5, a relation between the difference in image density plotted against and the sensitivity (half-life exposure) ratio is shown in FIG. 1.

TABLE 4

| | | | E1/2 ($\mu$J/cm$^2$) | | Sensitivity | Difference |
|---|---|---|---|---|---|---|
| | Hole transferring material | Electron transferring material | Positive charging sensitivity | Negative charging sensitivity | ratio (negative/positive) | in image density ΔID |
| Example 1 | HT-1 | ET-101 | 0.73 | 2.64 | 3.62 | 0.14 |
| Example 2 | HT-1 | ET-102 | 0.74 | 2.70 | 3.65 | 0.15 |
| Example 3 | HT-1 | ET-103 | 0.72 | 2.75 | 3.82 | 0.18 |
| Example 4 | HT-1 | ET-109 | 0.71 | 2.64 | 3.72 | 0.17 |
| Example 5 | HT-1 | ET-110 | 0.71 | 2.70 | 3.80 | 0.17 |
| Example 6 | HT-1 | ET-201 | 0.75 | 2.75 | 3.67 | 0.14 |
| Example 7 | HT-1 | ET-203 | 0.74 | 2.76 | 3.73 | 0.15 |

TABLE 4-continued

| | Hole transferring material | Electron transferring material | E1/2 ($\mu$J/cm$^2$) Positive charging sensitivity | E1/2 ($\mu$J/cm$^2$) Negative charging sensitivity | Sensitivity ratio (negative/positive) | Difference in image density ΔID |
|---|---|---|---|---|---|---|
| Example 8 | HT-1 | ET-204 | 0.75 | 2.78 | 3.71 | 0.13 |
| Example 9 | HT-1 | ET-305 | 0.69 | 2.75 | 3.99 | 0.18 |
| Example 10 | HT-1 | ET-309 | 0.70 | 2.76 | 3.94 | 0.16 |
| Example 11 | HT-1 | ET-310 | 0.68 | 2.58 | 3.79 | 0.18 |
| Example 12 | HT-2 | ET-109 | 0.72 | 2.67 | 3.71 | 0.16 |
| Example 13 | HT-2 | ET-203 | 0.74 | 2.70 | 3.65 | 0.15 |
| Example 14 | HT-2 | ET-305 | 0.70 | 2.65 | 3.79 | 0.17 |
| Example 15 | HT-3 | ET-103 | 0.72 | 2.64 | 3.67 | 0.14 |
| Example 16 | HT-3 | ET-109 | 0.71 | 2.58 | 3.63 | 0.15 |
| Example 17 | HT-3 | ET-110 | 0.74 | 2.74 | 3.70 | 0.15 |
| Example 18 | HT-3 | ET-201 | 0.76 | 2.81 | 3.70 | 0.16 |
| Example 19 | HT-3 | ET-203 | 0.75 | 2.80 | 3.73 | 0.15 |
| Example 20 | HT-3 | ET-305 | 0.71 | 2.82 | 3.97 | 0.14 |
| Example 21 | HT-3 | ET-309 | 0.70 | 2.73 | 3.90 | 0.18 |
| Example 22 | HT-4 | ET-109 | 0.63 | 2.20 | 3.49 | 0.09 |
| Example 23 | HT-4 | ET-203 | 0.70 | 2.32 | 3.31 | 0.09 |
| Example 24 | HT-4 | ET-309 | 0.62 | 2.23 | 3.60 | 0.08 |
| Example 25 | HT-5 | ET-109 | 0.66 | 2.26 | 3.42 | 0.10 |
| Example 26 | HT-5 | ET-110 | 0.64 | 2.30 | 3.59 | 0.11 |
| Example 27 | HT-5 | ET-203 | 0.70 | 2.31 | 3.30 | 0.08 |
| Example 28 | HT-5 | ET-305 | 0.63 | 2.25 | 3.57 | 0.09 |
| Example 29 | HT-5 | ET-309 | 0.63 | 2.27 | 3.60 | 0.08 |
| Example 30 | HT-6 | ET-109 | 0.63 | 2.01 | 3.19 | 0.03 |
| Example 31 | HT-6 | ET-203 | 0.68 | 2.19 | 3.22 | 0.02 |
| Example 32 | HT-6 | ET-309 | 0.62 | 2.08 | 3.35 | 0.03 |

TABLE 5

| | Hole transferring material | Electron transferring material | E1/2 ($\mu$J/cm$^2$) Positive charging sensitivity | E1/2 ($\mu$J/cm$^2$) Negative charging sensitivity | Sensitivity ratio (negative/positive) | Difference in image density ΔID |
|---|---|---|---|---|---|---|
| Comp. Example 1 | HT-1 | ET-1 | 0.78 | 3.70 | 4.74 | 0.33 |
| Comp. Example 2 | HT-2 | ET-1 | 0.76 | 3.21 | 4.22 | 0.31 |
| Comp. Example 3 | HT-3 | ET-1 | 0.74 | 4.29 | 5.80 | 0.40 |
| Comp. Example 4 | HT-4 | ET-2 | 0.74 | 2.99 | 4.04 | 0.23 |
| Comp. Example 5 | HT-5 | ET-2 | 0.70 | 3.81 | 5.44 | 0.41 |
| Comp. Example 6 | HT-6 | ET-2 | 0.65 | 3.78 | 5.82 | 0.52 |

As is apparent from Tables 4 and 5 as well as FIG. 1, a ratio of [half-life exposure on negative charging] to [half-life exposure on positive charging] was 4 or less and the difference in image density (ΔID) was always 0.2 or less.

Examples 33 to 44

In the same manner as in Examples 1 to 32, except that hole transferring materials (HT-1, HT-2, HT-3, HT-4, HT-5 and HT-6) and electron transferring materials (ET-216 and ET-217, see structural formulas described below) shown in Table 6 were used, single-layer type photosensitive materials were produced, respectively.

With respect to the single-layer type electrophotosensitive materials obtained in Examples 33 to 34, the half-life exposure (on positive charging), half-life exposure (on negative charging) and transfer memory are evaluated. The results are shown in Table 6.

TABLE 6

| | Hole transferring material | Electron transferring material | E1/2 ($\mu$J/cm$^2$) Positive charging sensitivity | E1/2 ($\mu$J/cm$^2$) Negative charging sensitivity | Sensitivity ratio (negative/positive) | Difference in image density ΔID |
|---|---|---|---|---|---|---|
| Example 33 | HT-1 | ET-216 | 0.67 | 2.65 | 3.96 | 0.17 |
| Example 34 | HT-2 | ET-216 | 0.65 | 2.58 | 3.97 | 0.16 |
| Example 35 | HT-3 | ET-216 | 0.69 | 2.52 | 3.65 | 0.15 |
| Example 36 | HT-4 | ET-216 | 0.64 | 2.21 | 3.45 | 0.09 |
| Example 37 | HT-5 | ET-216 | 0.71 | 2.31 | 3.25 | 0.09 |
| Example 38 | HT-6 | ET-216 | 0.65 | 2.29 | 3.52 | 0.12 |
| Example 39 | HT-1 | ET-217 | 0.73 | 2.72 | 3.73 | 0.16 |
| Example 40 | HT-2 | ET-217 | 0.72 | 2.70 | 3.75 | 0.16 |
| Example 41 | HT-3 | ET-217 | 0.75 | 2.75 | 3.67 | 0.15 |
| Example 42 | HT-4 | ET-217 | 0.67 | 2.25 | 3.36 | 0.10 |
| Example 43 | HT-5 | ET-217 | 0.65 | 2.28 | 3.51 | 0.12 |
| Example 44 | HT-6 | ET-217 | 0.69 | 2.30 | 3.33 | 0.08 |

Examples 45 to 56

2.2 Parts by weight of a X type metal-free phthalocyanine (CGM-1) as the electric charge generating material, 60 parts by weight of one selected from compounds of the general formula (1) [ET-116 and Et-117], the general formula (2) [ET-216 and ET-217] and the general formula (3) [ET-316 and ET-317] as the electron transferring material, 60 parts by weight of one selected from compounds of the general formula (5) [HT-501] and the general formula (6) [HT-6], compounds of the general formula (4) [AD401 and AD402], 100 parts by weight of a bis-Z type polycarbonate resin having a weight-number average molecular weight of 50,000 as the binder resin and 750 parts by weight of tetrahydrofuran were dispersed or dissolved in a ball mill for 24 hours to prepare a coating solution for single-layer type photosensitive layer. Then, an aluminum tube as the conductive substrate was coated with the coating solution by a dip coating method, followed by hot-air drying at 135° C. for minutes to produce single-layer type electrophotosensitive materials having a single photosensitive layer of 22.5 $\mu$m in film thickness, respectively.

Chemical structural formulas of the compounds used above are shown below.

ET-116

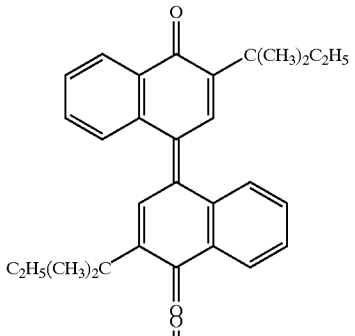

ET-117

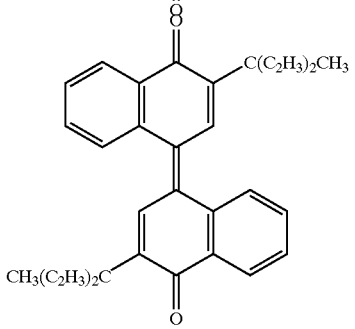

-continued

ET-216

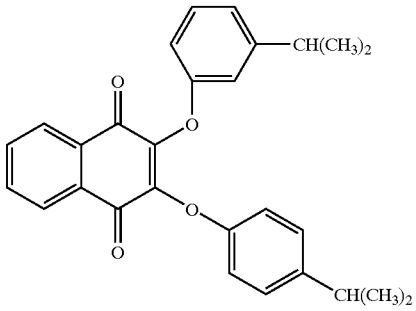

ET-217

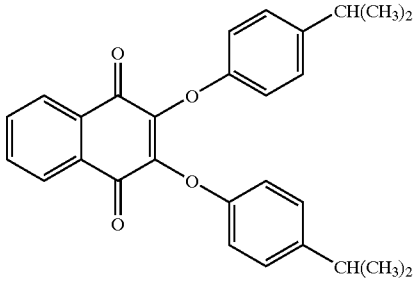

ET316

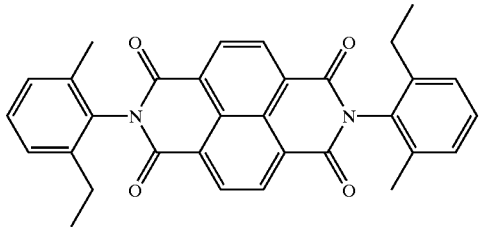

ET-317

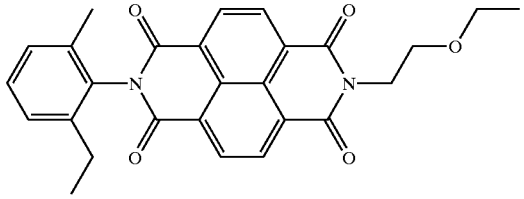

-continued

HT-501

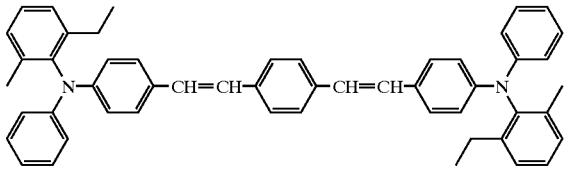

AD-401

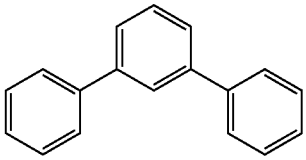

AD-402

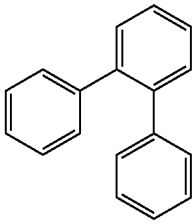

Comparative Examples 7 to 18

In the same manner as in Examples 45 to 56, except that no terphenyl compound was added, positive charging single-layer type photosensitive materials were produced, respectively.

With respect to the single-layer type photosensitive materials of Examples 45 to 56 and Comparative Examples 7 to 18, the ozone resistance was evaluated. The evaluation results are shown in Table 7 (Examples 33 to 34) and Table 8 (Comparative Examples 7 to 18), respectively.

TABLE 7

| | Electron transferring material | Hole transferring material | Terphenyl compound | Ozone resistance ΔV0 (V) |
|---|---|---|---|---|
| Example 45 | ET-116 | HT-501 | AD-401 | 20 |
| Example 46 | ET-117 | HT-501 | AD-402 | 30 |
| Example 47 | ET-116 | HT-6 | AD-401 | 30 |
| Example 48 | ET-117 | HT-6 | AD-402 | 35 |
| Example 49 | ET-216 | HT-501 | AD-401 | 10 |
| Example 50 | ET-217 | HT-501 | AD-402 | 10 |
| Example 51 | ET-216 | HT-6 | AD-401 | 15 |
| Example 52 | ET-217 | HT-6 | AD-402 | 15 |
| Example 53 | ET-316 | HT-501 | AD-401 | 20 |
| Example 54 | ET-317 | HT-501 | AD-402 | 20 |
| Example 55 | ET-316 | HT-6 | AD-401 | 25 |
| Example 56 | ET-317 | HT-6 | AD-402 | 24 |

TABLE 8

| | Electron transferring material | Hole transferring material | Terphenyl compound | Ozone resistance ΔV0 (V) |
|---|---|---|---|---|
| Comp. Example 7 | ET-116 | HT-501 | no addition | 80 |
| Comp. Example 8 | ET-117 | HT-501 | no addition | 85 |
| Comp. Example 9 | ET-116 | HT-6 | no addition | 90 |

TABLE 8-continued

| | Electron transferring material | Hole transferring material | Terphenyl compound | Ozone resistance ΔV0 (V) |
|---|---|---|---|---|
| Comp. Example 10 | ET-117 | HT-6 | no addition | 80 |
| Comp. Example 11 | ET-216 | HT-501 | no addition | 70 |
| Comp. Example 12 | ET-217 | HT-501 | no addition | 70 |
| Comp. Example 13 | ET-216 | HT-6 | no addition | 80 |
| Comp. Example 14 | ET-217 | HT-6 | no addition | 85 |
| Comp. Example 15 | ET-316 | HT-501 | no addition | 100 |
| Comp. Example 16 | ET-317 | HT-501 | no addition | 95 |
| Comp. Example 17 | ET-316 | HT-6 | no addition | 90 |
| Comp. Example 18 | ET-317 | HT-6 | no addition | 90 |

As is apparent from the results in Table 7 and Table 8, the value $\Delta V_0$ obtained in case where the terphenyl compound represented by the general formula (7) was added was smaller than that in case the terphenyl compound was not added, and the ozone resistance was improved.

The disclosures of Japanese Patent Application Serial Nos.11-337632 and 2000-54341, filed on Nov. 29, 1999 and Feb. 25, 2000, respectively, are incorporated herein by reference.

What is claimed is:

1. A positive charging single-layer type electrophotosensitive material comprising a conductive substrate and a photosensitive layer formed on the conductive layer, the photosensitive layer containing a selectively determined phthalocyanine compound as an electric charge generating material with at least a hole transferring material and an electron transferring material which are determined selectively, such that a large half-life exposure between a half-life exposure on positive charging and a half-life exposure on negative charging is four times or less as much as that of the other half-life exposure.

2. The positive charging single-layer type electrophotosensitive material according to claim 1, wherein the half-life exposure on positive charging is smaller than the half-life exposure on negative charging.

3. The positive charging single-layer type electrophotosensitive material according to claim 2, which contains, as the electron transferring material, at least one compound represented by the general formula (1):

(1)

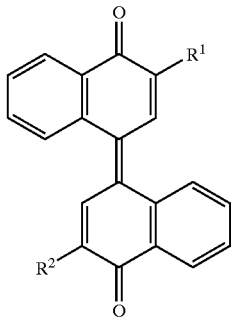

wherein $R^1$ and $R^2$ are the same or different and each represents a monovalent hydrocarbon group which may have a substituent, the general formula (2):

(2)

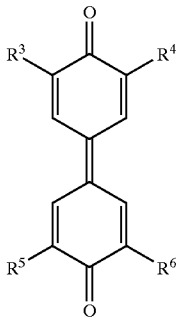

wherein $R^3$, $R^4$, $R^6$ and $R^6$ are the same or different and each represents an alkyl group or an aryl group, the general formula (3):

(3)

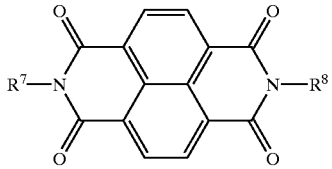

wherein $R^7$ and $R^8$ are the same or different and each represents a monovalent hydrocarbon group which may have a substituent, or the general formula (4):

(4)

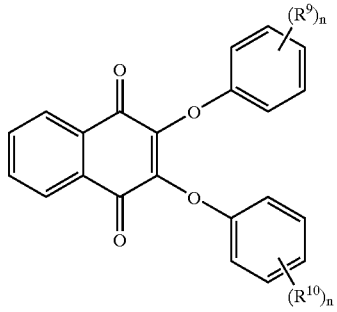

wherein $R^9$ and $R^{10}$ are the same or different and each represents an alkyl group, a halogenated alkyl group, an aryl group, an aralkyl group, an alkoxy group, an aryloxy group, an aralkyloxy group, an acyl group, an alkoxycarbonyl group, an aryloxycarbonyl group, an aralkyloxycarbonyl group, or a nitro group, and n represents an integer of 0 to 3.

4. The positive charging single-layer type electrophotosensitive material according to claim 2, which contains, as the hole transferring material, at least one compound represented by the general formula (5):

(5)

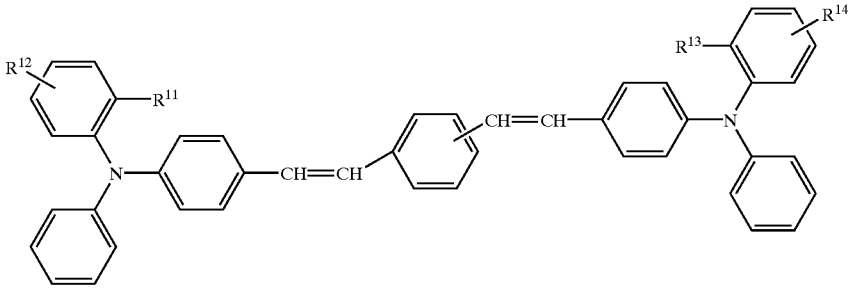

wherein $R^{11}$ and $R^{13}$ are the same or different and each represents an alkyl group which may have a substituent, an aryl group which may have a substituent, or an aralkyl or alkoxy group which may have a substituent, and $R^{12}$ and $R^{14}$ are the same or different and each represents a hydrogen atom, or an alkyl or alkoxy group which may have a substituent, provided that $R^{12}$ and $R^{14}$ are hydrogen atoms when the substitution position of $R^{12}$ and $R^{14}$ is para-position, or the general formula (6):

(6)

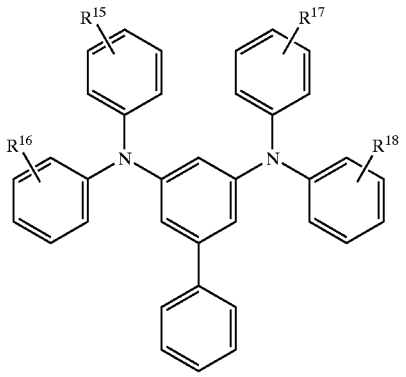

wherein $R^{15}$ and $R^{17}$ represent the same or different alkyl group, and $R^{16}$ and $R^{18}$ are the same or different and each represents a hydrogen atom or an alkyl group.

5. The positive charging single-layer type electrophotosensitive material according to claim 2, which contains a terphenyl compound represented by the general formula (7):

(7)

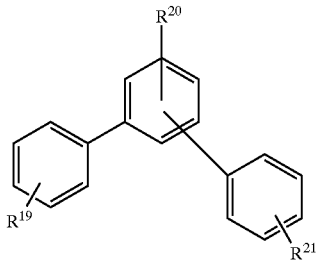

wherein $R^{19}$, $R^{20}$ and $R^{21}$ are the same or different and each represents a hydrogen atom, or an alkyl, aryl or amino group which may have a substituent.

6. The single-layer type electrophotosensitive material according to claim 2, which contains the electron transferring material represented by the general formula (1), the hole transferring material represented by the general formula (6), and the terphenyl compound represented by the general formula (7).

7. The positive charging single-layer type electrophotosensitive material according to claim 2, which contains, as a binder resin, a bisphenol Z polycarbonate resin having a weight-average molecular weight of 10,000 to 400,000.

8. A positive charging reversal development type digital image forming apparatus, comprising the positive charging electrophotosensitive material of claim 2, said reversal development type digital image forming apparatus being provided with at least a main charging step, an exposure step, a developing step, a transferring step, a charge neutralizing step and a cleaning step in the forward direction of the electrophotosensitive material, characterized in that the voltage to be applied in the transferring step has a negative polarity and the voltage to be applied in the charging step has a positive polarity.

9. A positive charging reversal development type digital image forming apparatus, comprising the positive charging electrophotosensitive material of claim 1, said reversal development type digital image forming apparatus being provided with at least a main charging step, an exposure step, a developing step, a transferring step, a charge neutralizing step and a cleaning step in the forward direction of the electrophotosensitive material, wherein the voltage to be applied in the transferring step has a polarity reverse to that of the voltage to be applied in the charging step.

* * * * *